United States Patent [19]

Mast et al.

[11] Patent Number: 4,512,293

[45] Date of Patent: Apr. 23, 1985

[54] OIL RECOVERY SYSTEM FOR TWO CYCLE DIESEL ENGINES

[76] Inventors: Steven C. Mast, 2175 Garfield, Eugene, Oreg. 97405; Frederick D. Altman, 3120 County Farm Rd., Eugene, Oreg. 97401

[21] Appl. No.: 601,012

[22] Filed: Apr. 16, 1984

[51] Int. Cl.[3] ..... F02B 75/02

[52] U.S. Cl. ..... 123/65 B; 123/65 BA; 123/196 R

[58] Field of Search ..... 123/65 B, 65 BA, 55 V, 123/564, 65 R, 196 R; 60/611

[56] References Cited

U.S. PATENT DOCUMENTS 4,062,333 12/1977 Matsuda et al. ..... 123/564

OTHER PUBLICATIONS

"Maintenance Manual" GM Diesel Power, 7/1952, pp. 17–18.

"Engine Maintenance Manual" No. 252C for Model 567C Engines, 3/1961, p. 114.

*Primary Examiner*—E. Rollins Cross

*Attorney, Agent, or Firm*—James D. Givnan, Jr.

[57] ABSTRACT

A reservoir is provided with a mounting flange arrangement for reservoir attachment to an engine block to receive engine oil accumulating in an engine air box. A pump on the reservoir is intermittently activated by the vehicle electrical system to pump reservoir contents back to the engine oil sump. A reservoir outlet conduit terminates coupled to an engine dipstick opening to utilize existing block openings.

4 Claims, 2 Drawing Figures

OIL RECOVERY SYSTEM FOR TWO CYCLE DIESEL ENGINES

BACKGROUND OF THE INVENTION

The present invention concerns a system for recovering lubrication oil from a Diesel engine air box and returning same to the engine crankcase.

In two cycle Diesel truck engines lubrication oil migrates upwardly along cylinder walls and eventually enters the engine air plenum, termed air box, from which it is vented overboard usually onto a roadway. With piston and ring wear the problem becomes more serious and it is not uncommon for several quarts of lubricating oil to be vented in this manner overboard during an eight hour period of engine operation. To a truck operator such an oil loss can constitute considerable expense particularly when viewed from a fleet operation standpoint. A further consequence of such overboard venting of oil is that oil entering the slipstream moving past an engine is carried onto trailer surfaces resulting in more frequent washings of same than would otherwise be required. Similarly, it is not uncommon for trailer carried loads to be contaminated with such oil. Further, in excessive cases, the venting of oil overboard from a two cycle Diesel engine additionally constitutes both a nuisance and a hazard to the motoring public with airbourne oil resulting road film and may expose the truck operator to penalties under various environmental regulations.

SUMMARY OF THE PRESENT INVENTION

The present invention is embodied within a system for receiving oil from a Diesel engine air box of plenum and returning same to the engine crankcase.

The present system includes a reservoir preferably in place on the engine to receive oil that has accumulated in the engine air box and which was heretofore vented overboard onto the road surface. A pump is intermittently energized to return reservoir contents back to the engine crankcase against crankcase pressure. The pump may be in circuit with a driver actuated switch or with other switch means intermittently closed during truck operation. The reservoir is provided with a baffle to minimize oil foaming. The present system utilizes existing engine block openings to avoid modification of the block or oil pan.

U.S. Pat. No. 4,062,333 is of interest in that it discloses an oil return from a supercharger reservoir.

Important objectives of the present system include the provision of a system readily mountable on a two cycle Diesel engine and which utilizes existing engine components to preclude engine modification and hance invalidation of manufacturer's warranties; the provision of an oil return system which may be of unitary and compact assembly to enable installation in the engine compartment of a truck tractor as an engine mounted accessory; the provision of an oil return system compatible with a truck electrical system for intermittent operation to empty the system reservoir at intervals; the provision of an oil return system which salvages lubricating oil otherwise vented to vehicle slipstream.

DETAILED DESCRIPTION OF THE PREFERRED EMBODIMENT

Figure 1:
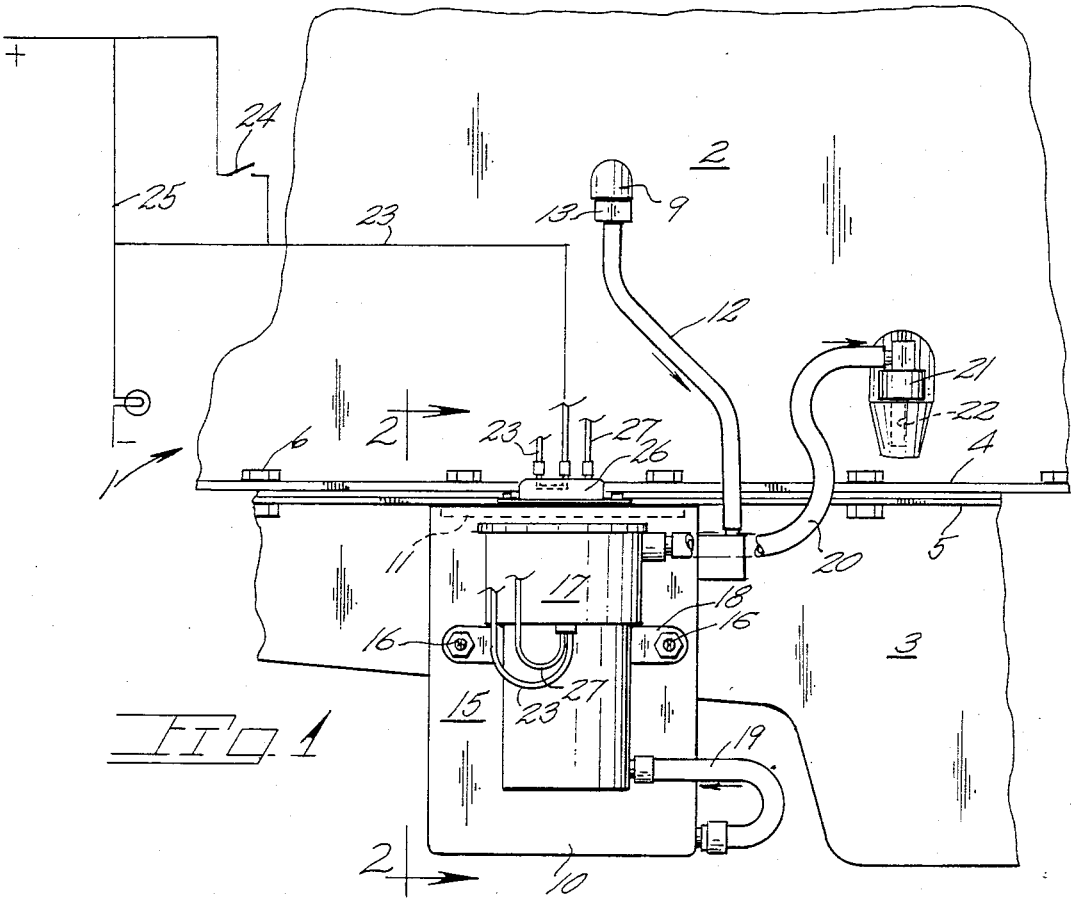
FIG. 1 is a fragmentary elevational view of a Diesel engine equipped with the present system.
Figure 2:
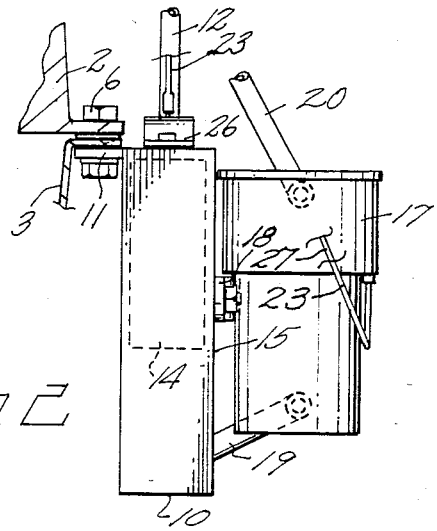
FIG. 2 is a vertical, elevational view taken along line 2—2 of FIG. 1.

With continuing attention to the drawing wherein applied reference numerals indicate parts hereinafter similarly identified, the reference numeral 1 indicates generally a portion of a Diesel engine of the two cycle type with an engine block indicated at 2 equipped with a crankcase oil pan at 3. Typically the engine block includes a flange 4 which an oil pan flange 5 is mounted by a series of bolts as at 6.

An air box (not shown) of the engine serves in the conventional manner to receive a pressurized flow of air from a blower which air is subsequently directed to the engine cylinders whereat fuel is injected. Lubricating oil working its way up the cylinder walls past piston oil control rings eventually enters the air box via air ports. To prevent the collection of oil in any great quantity in the engine air box, a vent at 9 is provided on block 1 which heretofore directed air box accumulated oil to the atmosphere and into the vehicle slipstream.

The present system includes a reservoir or tank at 10 for mounting on an engine as by a bracket 11 apertured to receive oil pan mounting bolts 6. An oil inlet line 12 serves the reservoir and is coupled at 13 at its upper end to air box vent 9 which, for the sake of convenience, may be the same vent previously used to discharge air box oil to the atmosphere. Reservoir 10 is equipped with a baffle 14. A front wall 15 of the reservoir is equipped with a pair of studs 16 on which a later described pump assembly is mounted.

A 12 volt electric pump at 17 is supported on the reservoir by a pump bracket 18. A pump inlet conduit at 19 directs oil from the reservoir bottom to the intake side of pump 17. A pump outlet conduit at 20 directs oil back to the oil pan sump via a coupling 21 inserted into an engine dipstick opening at 20.

To greatly facilitate installation of the present system it has been found advisable to install fitting 21 in an unused dipstick port 22 of the crankcase since two cycle Diesel engines are equipped with at least two dipstick openings. Multiple dipstick openings are provided to assure convenient access by the truck operator regardless of the location of engine compartment accessory equipment which will vary between engine installations.

A power source for pump 17 is indicated as a conductor 23 in circuit with a switch 24 and with the vehicle electrical system which may be closed for brief periods of pump operation. If desired, switch 24 may dispensed with and the conductor 23 wired into a circuit 25 with an intermittent power supply such as the vehicle brake light circuit. A ground at 27 completes a pump circuit back to a grounded terminal box 26.

In use, pump 17 is momentarily energized either manually or automatically as noted above. The pump may be a 12 volt Stewart-Warner electric fuel pump capable of evacuating the reservoir during momentary operation.

While we have shown but one embodiment of the invention it will be apparent to those skilled in the art that the invention may be embodied still otherwise without departing from the spirit and scope of the invention.

Having thus described the invention, what is desired to be secured under a Letters Patent is:

We claim:

1. An oil return system for collecting lubricating oil from a Diesel engine air box of a vehicle and returning same to an engine lubricating oil sump, said system comprising, a reservoir including mounting means, means communicating the engine air box with said reservoir for delivery of air box oil to the reservoir, an electric pump in place on said reservoir and a pump inlet in communication with said reservoir, a pump outlet in communication with the interior of the engine for discharging lubricating oil into the engine, and switch means in circuit with a power source and with said pump to control pump operation.

2. The system claimed in claim 1 wherein said switch means is in circuit with an intermittently closed circuit of the vehicle electrical system.

3. The system claimed in claim 1 wherein said mounting means comprises a flange adapted for bolted securement to the engine.

4. The system claimed in claim 1 wherein said pump outlet terminates at an engine oil dipstick opening.

* * * * *